US011326565B2

(12) United States Patent
Sakata et al.

(10) Patent No.: US 11,326,565 B2
(45) Date of Patent: May 10, 2022

(54) RECTIFICATION STRUCTURAL BODY

(71) Applicant: TIGERS POLYMER CORPORATION, Osaka (JP)

(72) Inventors: Shunsuke Sakata, Kobe (JP); Jun Hatakeyama, Kobe (JP)

(73) Assignee: TIGERS POLYMER CORPORATION, Osaka (JP)

( * ) Notice: Subject to any disclaimer, the term of this patent is extended or adjusted under 35 U.S.C. 154(b) by 441 days.

(21) Appl. No.: 16/678,349

(22) Filed: Nov. 8, 2019

(65) Prior Publication Data

US 2020/0158059 A1 May 21, 2020

(30) Foreign Application Priority Data

Nov. 16, 2018 (JP) ..... JP2018-215594

(51) Int. Cl.

| | |
|---|---|
| ***F02M 35/12*** | (2006.01) |
| ***F02M 35/10*** | (2006.01) |
| ***F02M 35/14*** | (2006.01) |
| ***F02M 35/02*** | (2006.01) |
| ***F02M 35/024*** | (2006.01) |

(52) U.S. Cl.
CPC .. *F02M 35/1216* (2013.01); *F02M 35/10262* (2013.01); *F02M 35/1261* (2013.01)

(58) Field of Classification Search
CPC ..... F02M 35/1216; F02M 35/10262; F02M 35/1261; F02M 35/1211; F02M 35/1244; F02M 35/1205; F02M 35/10295; F02M 35/1255; F02M 35/14; F02M 35/10; F02M 35/00; F02M 35/024; F02M 35/02
See application file for complete search history.

(56) References Cited

U.S. PATENT DOCUMENTS

| | | | | |
|---|---|---|---|---|
| 2003/0131897 | A1* | 7/2003 | Letourneau | F02M 35/10144 138/39 |
| 2005/0247034 | A1* | 11/2005 | Canova | F02M 35/161 55/385.3 |
| 2008/0028938 | A1* | 2/2008 | Li | F02M 35/10144 96/154 |
| 2008/0283014 | A1* | 11/2008 | Konzelmann | F02M 35/10386 123/184.21 |
| 2015/0075127 | A1* | 3/2015 | Schmid | F02M 35/024 55/502 |
| 2020/0340434 | A1* | 10/2020 | Stankavich | F02M 35/0205 |

FOREIGN PATENT DOCUMENTS

| | | | | |
|---|---|---|---|---|
| CN | 111980836 | A * | 11/2020 | F02M 35/10006 |
| CN | 112443434 | A * | 3/2021 | B01D 46/0043 |
| DE | 102010045985 | A1 * | 2/2012 | F02M 35/10013 |
| EP | 2072796 | A1 * | 6/2009 | F02M 35/024 |

(Continued)

*Primary Examiner* — Edgardo San Martin
(74) *Attorney, Agent, or Firm* — Pearne & Gordon LLP

(57) ABSTRACT

A rectification structural body includes an inlet port into which air from an air cleaner flows, an outlet port from which air flows out toward an airflow sensor, and a chamber provided between the inlet port and the outlet port. The inlet port and the outlet port are provided in such directions and at such positions that an air flow is bent in the chamber. The chamber includes two cases of a first case and a second case, the chamber being divided into the two cases.

7 Claims, 6 Drawing Sheets

(56) References Cited

FOREIGN PATENT DOCUMENTS

| | | | | | |
|---|---|---|---|---|---|
| JP | H10205416 | A | * | 8/1998 | |
| JP | 2000120497 | A | * | 4/2000 | ..... F02M 35/1227 |
| JP | 2001289132 | A | * | 10/2001 | |
| JP | 2010138845 | A | * | 6/2010 | |
| JP | 2014-040779 | A | | 3/2014 | |
| JP | 2014218895 | A | * | 11/2014 | |
| JP | 2015090126 | A | * | 5/2015 | |
| JP | 2015-108336 | A | | 6/2015 | |
| JP | 2021088933 | A | * | 6/2021 | ..... F02M 35/0204 |
| KR | 20090115766 | A | * | 11/2009 | |
| WO | WO-2013104797 | A1 | * | 7/2013 | ..... B01D 46/0005 |
| WO | WO-2020116486 | A1 | * | 6/2020 | |

* cited by examiner

RECTIFICATION STRUCTURAL BODY

CROSS-REFERENCE TO RELATED APPLICATION

This application claims priority from Japanese Patent Application No. 2018-215594 filed with the Japan Patent Office on Nov. 16, 2018, the entire content of which is hereby incorporated by reference.

BACKGROUND

1. Technical Field

The present disclosure relates to a rectification structural body.

2. Related Art

An internal combustion engine is used for various use applications such as an automobile, a motorcycle, and a power generation device. Air supplied to the internal combustion engine is filtered by an air cleaner provided in an intake system. In this manner, clean air is supplied to the internal combustion engine. In recent years, an airflow sensor (an air flowmeter) has been provided in the intake system of the internal combustion engine. The airflow sensor measures the amount of air sucked into the internal combustion engine. A fuel supply is controlled such that fuel corresponding to the measured air amount is suitably supplied. Normally, the airflow sensor is provided in a flow path downstream of the air cleaner.

In order to enhance the measurement accuracy of the airflow sensor, a rectification structure is, in some cases, arranged between the airflow sensor and the air cleaner.

For example, in a rectification structure disclosed in JP-A-2015-108336, a gradually-changing portion configured such that a flow path sectional area gradually decreases is provided at a branching portion of a pipe body branching from an air cleaner to an airflow sensor. By such a rectification structure, air is rectified in an upstream side of the airflow sensor.

Moreover, in a rectification structure disclosed in JP-A-2014-040779, a curved rectifier configured to guide air to a duct provided with an airflow sensor is used. The curvature of the curved plate decreases toward a downstream side. By such a rectification structure, flow rate measurement accuracy is improved.

SUMMARY

A rectification structural body includes: an inlet port into which air from an air cleaner flows; an outlet port from which air flows out toward an airflow sensor; and a chamber provided between the inlet port and the outlet port. The inlet port and the outlet port are provided in such directions and at such positions that an air flow is bent in the chamber, the chamber includes two cases of a first case and a second case, the chamber being divided into the two cases, a substantially arc-shaped first rib is provided to protrude from the first case, an end portion of the first rib is apart from the second case, a substantially arc-shaped second rib is provided to protrude from the second case, the second rib is provided substantially parallel to the first rib to overlap with the first rib with a predetermined spacing, and the first rib and the second rib form, in the chamber, a flow path wall such that a flow of air flowing into the chamber through the inlet port curves and directs toward the outlet port.

DETAILED DESCRIPTION

Figure 1:
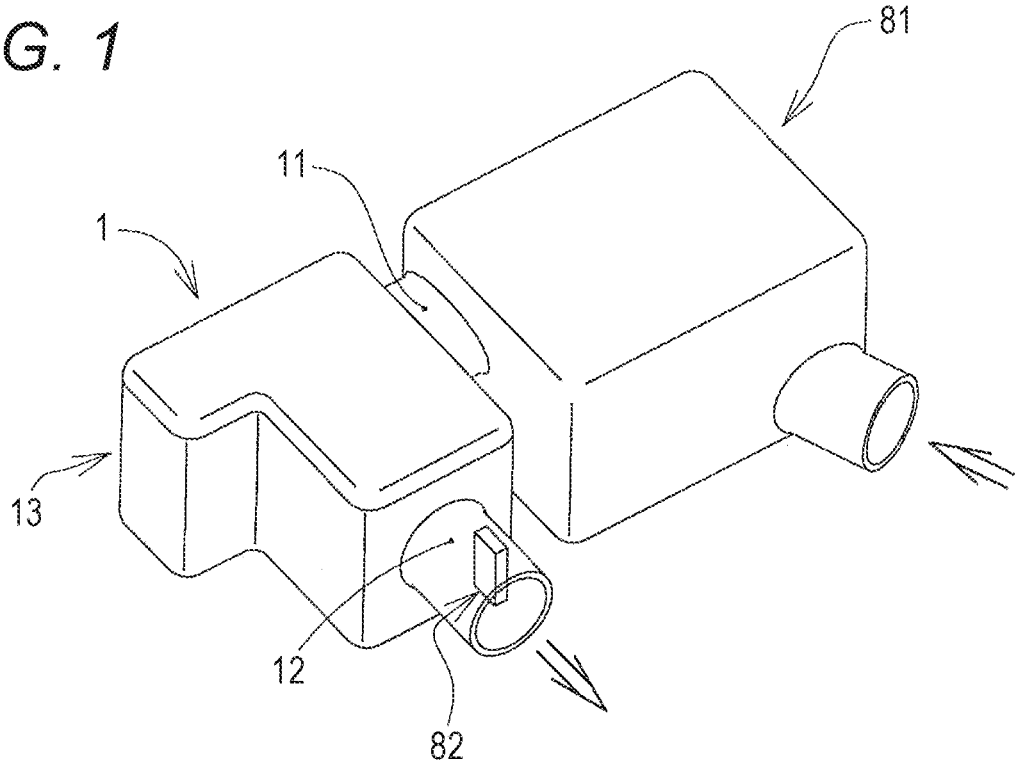
FIG. 1 is a perspective view of part of an intake system of an internal combustion engine incorporating a rectification structural body of a first embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

When the curved rectifier is utilized as in the rectification structure of JP-A-2014-040779, an air flow is easily efficiently rectified. However, it has been found that even when a structure in which such a rectifier is provided in a flow path is employed, the output of the airflow sensor may be less stabilized and it may be difficult to achieve sensing with high accuracy.

For example, when the output of the airflow sensor is not stabilized and responsiveness of sensing performance is poor, it is difficult to achieve quick control upon control of an internal combustion engine. For this reason, degradation of the output power and fuel efficiency of the internal combustion engine is easily caused.

One object of the present disclosure is to provide a rectification structural body configured so that the output of an airflow sensor can be stabilized and sensing performance can be enhanced.

As a result of intensive study, an inventor(s) has found that when burrs or steps due to welding are present in a rectification structure, the output of an airflow sensor is less stabilized. That is, in many cases, for implementing the rectification structure having the rectifier as disclosed in JP-A-2014-040779, injection molding of separate members is performed in such a form that the rectifier itself or the periphery of the rectifier is divided into the separate members, and the injection-molded separate members are assembled. However, upon assembly of the separate members, burrs may be formed at welded portions. Alternatively, even in the case of not performing welding, favorable assembly accuracy may not be obtained, and such inaccuracy may cause the steps at the welded portions. The inventor(s) has found that the burrs or the steps at the periphery of the rectifier due to such a manufacturing error is a negative factor for stabilization of the output of the airflow sensor.

The inventor(s) has further conducted study for implementing the rectification structure while reducing occurrence of the steps or the burrs. As a result, the inventor(s) has found that separation of an end portion of a rib for rectification from other members and arrangement of other ribs at such a separated portion (a clearance between the end portion of the rib and each of the other members) can enhance a rectification effect and can stabilize the output of the airflow sensor, and has completed the technique of the present disclosure.

A rectification structural body includes: an inlet port into which air from an air cleaner flows; an outlet port from which air flows out toward an airflow sensor; and a chamber provided between the inlet port and the outlet port. The inlet port and the outlet port are provided in such directions and at such positions that an air flow is bent in the chamber, the chamber includes two cases of a first case and a second case, the chamber being divided into the two cases, a substantially arc-shaped first rib is provided to protrude from the first case, an end portion of the first rib is apart from the second case, a substantially arc-shaped second rib is provided to protrude from the second case, the second rib is provided substantially parallel to the first rib to overlap with the first rib with a predetermined spacing, and the first rib and the second rib form, in the chamber, a flow path wall such that a flow of air flowing into the chamber through the inlet port curves and directs toward the outlet port (a first aspect).

The rectification structural body according to the first aspect preferably includes a Helmholtz resonator including a space of the chamber as a volume chamber separated from a flow path by the first rib and a space between the second rib and the first rib as a communication pipe, and having a resonant frequency of 100 Hz to 1500 Hz (a second aspect).

Moreover, in the rectification structural body according to the first or second aspect, a third rib having a substantially arc-shaped portion substantially parallel to the first rib is preferably provided to protrude from the first case in the flow path, and an end portion of the third rib is preferably apart from the second case (a third aspect).

Further, in the rectification structural body according to the first or second aspect, a fourth rib having an arc-shaped portion substantially parallel to the first rib is preferably provided to protrude from the second case in the flow path, and an end portion of the fourth rib is preferably apart from the first case (a fourth aspect).

In addition, in the rectification structural body according to the second aspect, a spacing between the end portion of the first rib and the second case is preferably 2 mm to 20 mm, and a spacing between the first rib and the second rib is preferably 2 mm to 20 mm (a fifth aspect).

According to the rectification structural body of the first aspect, the output of the airflow sensor is stabilized, and the sensing performance is enhanced.

Further, according to the rectification structural body of the second aspect, part of the space in the chamber can be used as the Helmholtz resonator. With this configuration, noise of an intake system can be reduced. Moreover, even in a case where a communication path for the resonator is provided in the flow path, the output of the airflow sensor is also stabilized, and the sensing performance is also enhanced.

In addition, according to the rectification structural body of the third and fourth aspects, a rectification effect is enhanced, and the output of the airflow sensor is more stabilized.

Moreover, according to the rectification structural body of the fifth aspect, the rectification effect is more enhanced, and the output of the airflow sensor is more stabilized.

Hereinafter, embodiments of the present disclosure will be described with reference to the drawings, a rectification structural body used for an intake system configured to supply air to an internal combustion engine of an automobile being taken as an example. The technique of the present disclosure is not limited to the individual embodiments described below, and can be implemented as changed forms of the embodiments described below. For example, a use target for the internal combustion engine is not limited to the automobile, and may be a motorcycle, a power generation facility, a power facility, and the like.

Figure 2:
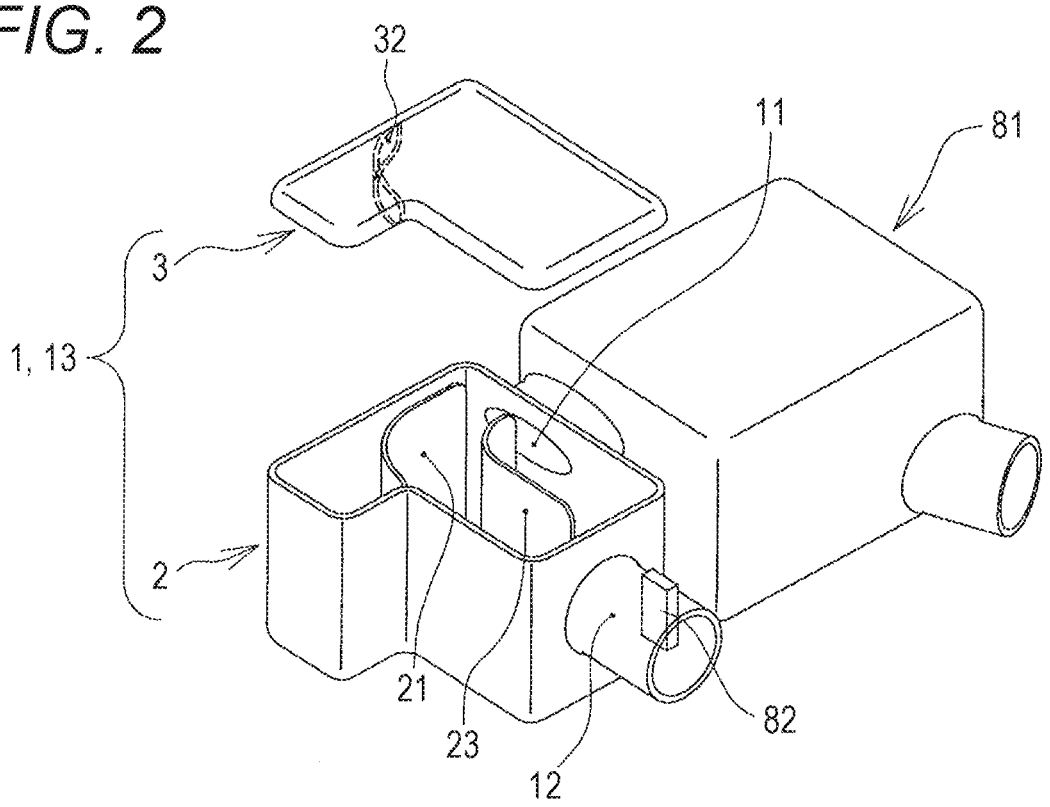
FIG. 2 is an exploded perspective view of a structure of the rectification structural body of the first embodiment.

FIG. 1 illustrates part of an intake system of an internal combustion engine incorporating a rectification structural body 1 of a first embodiment. FIG. 1 illustrates only a portion from an air cleaner 81 to an airflow sensor 82, and does not show other portions. Note that the airflow sensor 82 is normally provided in the form of protruding inward of an air duct. FIGS. 1 and 2 illustrate the rectangular parallelepiped airflow sensor 82 in a see-through state.

Air is sucked through an intake duct (not shown) connected to an upstream side of the air cleaner 81. The sucked air is filtered by a filter medium in the air cleaner 81, passes through the rectification structural body 1, and passes through the duct provided with the airflow sensor 82. Further, the air is supplied to the internal combustion engine through a throttle body (not shown) and an intake manifold (not shown).

Figure 3:
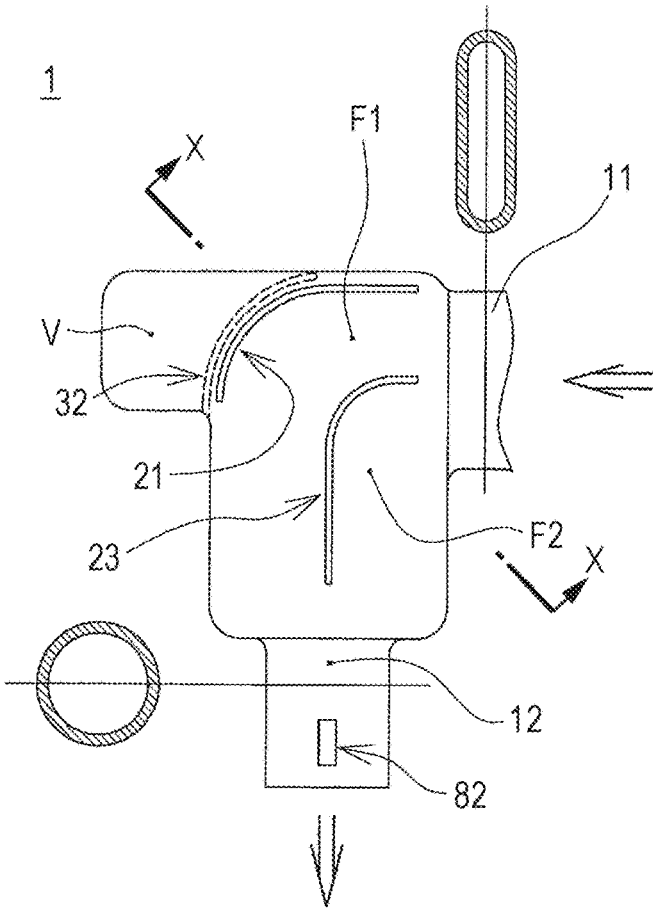
FIG. 3 is a plan view of the structure of the rectification structural body of the first embodiment.
Figure 4:
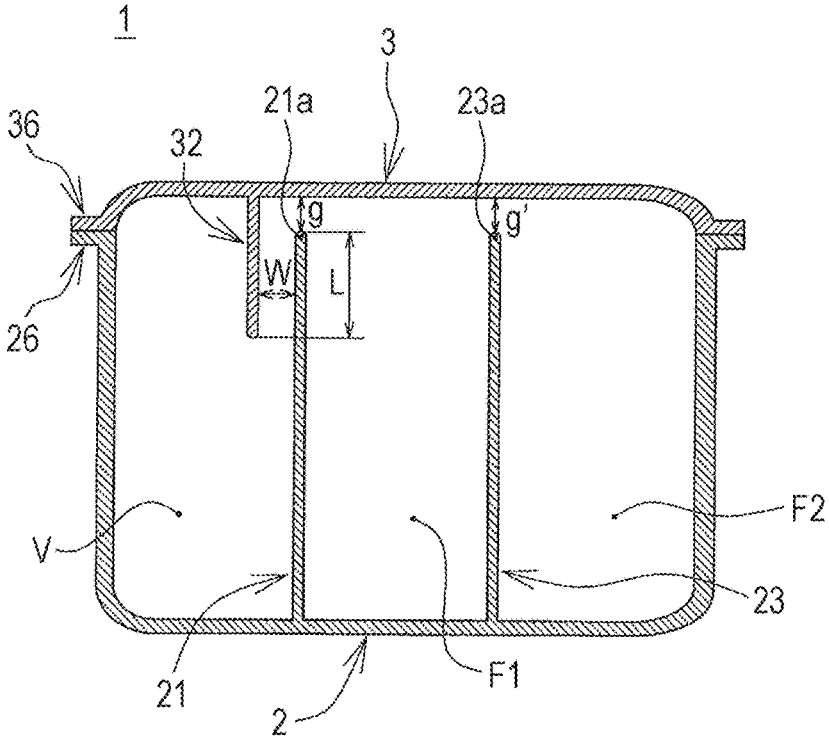
FIG. 4 is a sectional view of the structure of the rectification structural body of the first embodiment.

FIG. 2 is an exploded perspective view of a structure of the rectification structural body 1 of the present embodiment. Moreover, FIG. 3 is a plan view of the structure of the rectification structural body 1 of the present embodiment. Further, FIG. 4 illustrates an X-X section of FIG. 3.

The rectification structural body 1 has an inlet port 11, an outlet port 12, and a chamber 13. Air from the air cleaner 81 flows into the inlet port 11. Air flows out of the outlet port 12 toward the airflow sensor 82. The chamber 13 is provided between the inlet port 11 and the outlet port 12.

In the rectification structural body 1, the inlet port 11 and the outlet port 12 are provided in such directions and at such positions that an air flow is bent in the chamber 13. The form of bending of the air flow is not specifically limited. Bending of the air flow may be bending in a C-shape or an L-shape, or may be bending in an S-shape such that the air flow meanders in the chamber 13. Although not essential, air flowing from the inlet port 11 changes, in the present embodiment, the direction of the air flow by about 90 degrees, and then, flows out of the outlet port 12. The angle of bending of the air flow is not limited to 90 degrees. Such an angle is typically about 30 degrees to about 120 degrees. The specific shapes of the inlet port 11 and the outlet port 12 are not specifically limited. In the present embodiment, the inlet port 11 includes a flat oval pipe, and the outlet port 12 includes a cylindrical pipe. The air cleaner 81 is connected to the inlet port 11. The airflow sensor 82 is attached to a pipe body (the duct) connected to the outlet port 12.

The chamber 13 of the rectification structural body 1 includes a first case 2 and a second case 3. Specifically, the chamber 13 of the rectification structural body 1 is divided into the two cases of the first case 2 and the second case 3. In the division into the two cases, the first case 2 and the second case 3 are typically formed such that each of the first case 2 and the second case 3 is in the form of an opening box having a hat-shaped section, as illustrated in FIG. 4. Note that the division into the two cases may be such division that one of the first case 2 and the second case 3 is in the form of an opening box having a hat-shaped section and the other is in the form of a plate-shaped lid.

The first case 2 and the second case 3 are integrated into the hollow box-shaped chamber 13. The inlet port 11 and the outlet port 12 may be formed in advance at either one of the first case 2 or the second case 3. Alternatively, when the first case 2 and the second case 3 are integrated, the inlet port 11 and the outlet port 12 may be formed at a joint portion between these cases.

The specific method for integrating the first case 2 and the second case 3 is not specifically limited. Typically, the first case 2 and the second case 3 are provided with flange portions 26, 36. The flange portions 26, 36 are welded to each other, and in this manner, the first case 2 and the second case 3 are integrated. Welding may be hot plate welding or vibration welding. Alternatively, integration of the first case 2 and the second case 3 may be performed using an adhesive. Alternatively, integration of the first case 2 and the second case 3 may be performed using a fastening member such as a clip, a band, and a screw. Upon integration of the first case 2 and the second case 3, the first case 2 and the second case 3 are preferably integrated such that the chamber 13 holds airtightness. Upon integration of the first case 2 and the second case 3, a seal member may be provided therebetween.

A first rib 21 is provided in the chamber 13. The first rib 21 functions as a rectifier configured to rectify the air flow in the chamber 13.

The substantially arc-shaped first rib 21 is provided to protrude from the first case 2. The first rib 21 is preferably integrally molded with the first case 2. The first rib 21 is provided to protrude from the first case 2 to the second case 3 to divide an internal space of the chamber 13. By the first rib 21 and a later-described second rib 32, flow paths F1, F2 are formed in the chamber 13. The flow paths F1, F2 are such flow paths that the air flow into the chamber 13 through the inlet port 11 curves and directs toward the outlet port 12. The first rib 21 and the second rib 32 together function as a flow path wall (a rectifier) configured to rectify the air flow in the chamber 13. A space V on the side opposite to the flow paths F1, F2 across the first rib 21 in the internal space of the chamber 13 is a space where not much air substantially flows.

As viewed along the direction of protrusion of the first rib 21 (i.e., as viewed in FIG. 3), the first rib 21 is provided in an arc shape to form the smoothly-curved flow paths F1, F2. As long as the air flow is smoothly guided, the specific form of the first rib 21 is not limited to the arc shape, and may be an elliptic arc shape, a long arc shape, a combination of an arc and a straight line, or a substantially-arc-shaped form typified by, e.g., a curve with a changing curvature.

As illustrated in FIG. 4, an end portion 21*a* of the first rib 21 is apart from the second case 3 in the direction of protrusion of the first rib 21. A clearance g is provided between the second case 3 and the end portion 21*a* of the first rib 21. The clearance g is provided in an elongated slit shape between the second case 3 and the first rib 21. The length of the clearance g is preferably 1 mm to 20 mm, and more preferably 2 mm to 10 mm.

Although not essential, a third rib 23 may be provided to protrude to the flow path from the first case 2. As viewed along the direction of protrusion of the first rib 21 (as viewed in FIG. 3), the third rib 23 has a substantially arc-shaped portion substantially parallel to the first rib 21. In the case of providing the third rib 23, the third rib 23 is preferably provided such that the flow path is divided into the outer flow path F1 and the inner flow path F2. Two or more third ribs 23 may be provided as in a later-described simulation calculation example to form three or more divided flow paths.

Note that the arc-shaped portion of the third rib 23 is not necessarily completely parallel to the first rib. Moreover, in the case of providing the third rib 23, an end portion 23*a* of the third rib is preferably apart from the second case 3, and a clearance g' is preferably provided therebetween. The size of the clearance g' is preferably 1 mm to 20 mm, and more preferably 2 mm to 10 mm.

As illustrated in FIGS. 3 and 4, the substantially arc-shaped second rib 32 is provided to protrude toward the first case 2 from the second case 3. Moreover, an end portion of the second rib 32 is apart from the first case 2. Although not essential, the second rib 32 is, in the present embodiment, provided in the side opposite to the flow paths F1, F2 across the first rib 21. That is, as in the present embodiment, the first rib 21 and the second rib 32 may be provided concentrically such that the second rib 32 is on the outer side of a circle. As in other embodiments described later, the second rib may be provided on the inner side of the circle.

Further, as illustrated in FIG. 4, the second rib 32 is provided substantially parallel to the first rib 21 to overlap with the first rib 21 with a predetermined spacing W. That is, in a predetermined zone in the direction of protrusion of the first rib 21 and the second rib 32, the first rib 21 and the second rib 32 are provided to overlap with each other with the predetermined distance W across a length L. The distance W between these ribs is preferably 1 mm to 20 mm, and more specifically 2 mm to 10 mm. Moreover, the overlapping length L between these ribs is preferably equal to or greater than 10 mm, and more preferably equal to or greater than 15 mm.

Since the first rib 21 and the second rib 32 are provided as described above, the internal space of the chamber 13 is substantially partitioned such that the flow paths F1, F2 and the space V on the side opposite to the flow paths are provided. Note that the end portion 21*a* of the first rib 21 is apart from the second case 3. Further, the first rib 21 and the second rib 32 are also apart from each other with the predetermined distance W. Thus, the flow paths F1, F2 and the space V on the side opposite to the flow paths are not completely divided (isolated) from each other, but communicate with each other.

When the vicinity of the end portion 21*a* of the first rib 21 is viewed from the side of the flow path F1, the clearance g is present between the first rib 21 and the second case 3, but the second rib 32 stands ahead of the clearance g. Thus, air which is about to flow into the space V from the side of the flow path F1 is blocked by the second rib 32. Thus, such an air flow reaches the space V on a far side, through the labyrinth-shaped flow path between the first rib 21 and the second rib 32. Less air flows in the labyrinth-shaped flow path. As described above, the first rib 21 and the second rib 32 together form, in the chamber 13, such a flow path wall that air having flowed into the chamber 13 through the inlet port curves and directs toward the outlet port.

Although not essential, the rectification structural body 1 may include a Helmholtz resonator utilizing the space V on the side opposite to the flow paths. That is, the Helmholtz resonator preferably includes the space V of the chamber 13 as a volume chamber separated from the flow path by the first rib 21 and the second rib 32, and a space between the second rib 32 and the first rib 21 as a communication pipe. The Helmholtz resonator has a resonant frequency of 100 Hz to 1500 Hz. As the clearance g between the end portion 21*a* of the first rib 21 and the second case 3 and the distance W between the first rib 21 and the second rib 32 increase, the sectional area of the communication pipe increases, and the resonant frequency of the Helmholtz resonator increases. As the overlapping length L between the first rib 21 and the second rib 32 increases, the length of the communication pipe increases, and the resonant frequency of the Helmholtz resonator decreases.

In the rectification structural body 1, materials forming the first case 2, the second case 3, the first rib 21, the second rib 32, and the like are not specifically limited. These components may be made of, e.g., thermoplastic resin. Moreover, manufacturing of the rectification structural body 1 can be performed by utilizing a well-known manufacturing method. For example, by injection molding of thermoplastic resin, the first case 2 integrated with the first rib 21 and the second case 3 integrated with the second rib 32 can be formed. Further, the first case 2 and the second case 3 are integrated by vibration welding, and in this manner, the rectification structural body 1 can be manufactured. The rectification structural body 1 may be manufactured by other methods.

Features and advantageous effects of the rectification structural body 1 of the above-described embodiment will be described. According to the rectification structural body 1 of the above-described embodiment, the output of the airflow sensor is stabilized, and sensing performance is enhanced.

First, factors for destabilizing the output of the airflow sensor in a typical technique will be described. Due to disturbance in the flow of air flowing into the airflow sensor, the output of the airflow sensor is destabilized. When there is a rapidly-changing portion such as rapid diameter narrowing or a step in a pipe line, the air flow is disturbed. For this reason, in, e.g., the technique of JP-A-2015-108336, a sectional change at such a portion is reduced such that air flow disturbance is decreased, and therefore, the output of the airflow sensor is stabilized.

Figure 8:
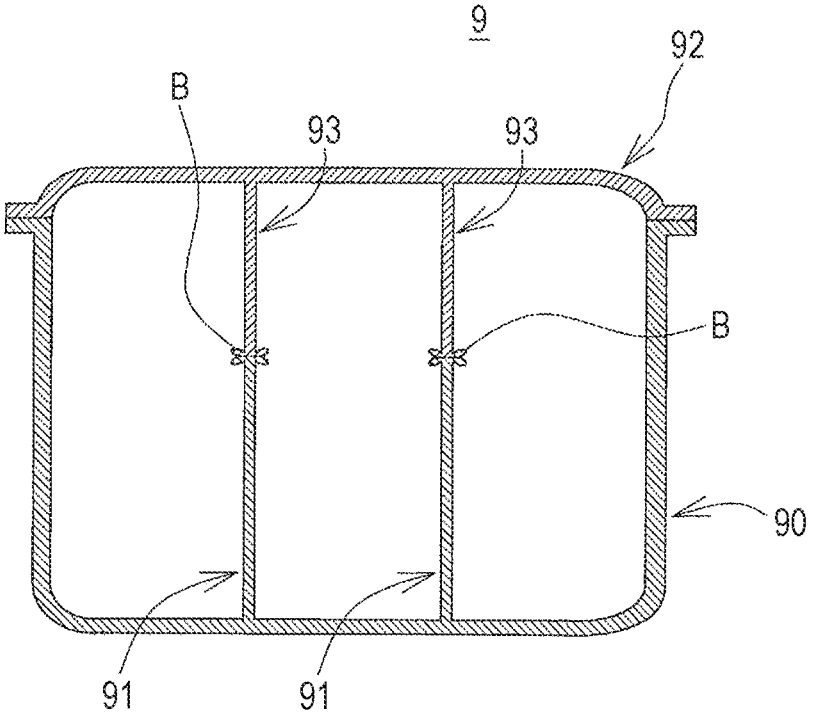
FIG. 8 is a sectional view of a structure of a rectification structural body of a typical example.

When a rectification structure provided with a rectifier configured to deflect an air flow in a chamber 13 as in JP-A-2014-040779 is implemented, the chamber 13 may be implemented by a welding structure. In this case, as in, e.g., a rectification structural body 9 of a typical example illustrated in FIG. 8, ribs 91 provided at a first case 90 and ribs 93 provided at a second case 92 may be welded to each other at rib tip ends. FIG. 8 illustrates a section at a spot corresponding to FIG. 4. However, in this case, welding burrs B or steps are caused at welded spots of rib tip end portions.

When the welding burrs B or the steps as illustrated in FIG. 8 are caused on a rib surface, an eddy and disturbance are caused in an air flow along the ribs. The eddy and the disturbance influence the output of the airflow sensor. The burrs and the steps vary reflecting the manufacturing variation, and therefore, the output of the airflow sensor also varies. Moreover, with the burrs or the steps, an air flow field easily greatly fluctuates due to a flow velocity and a flow velocity change. For this reason, when there are the burrs or the steps, the output of the airflow sensor also easily fluctuates over time. Due to such variation or fluctuation, the output of the airflow sensor is destabilized, and the sensing performance is degraded.

In the rectification structural body 1 of the above-described embodiment, the end portion 21*a* of the first rib is apart from the second case 3. Thus, less burrs or steps due to welding are caused at the first rib 21 dividing the flow path. Thus, according to the rectification structural body 1 of the above-described embodiment, destabilization of the output of the airflow sensor due to the burrs or the steps is reduced in advance, and the sensing performance is enhanced.

Figure 9:
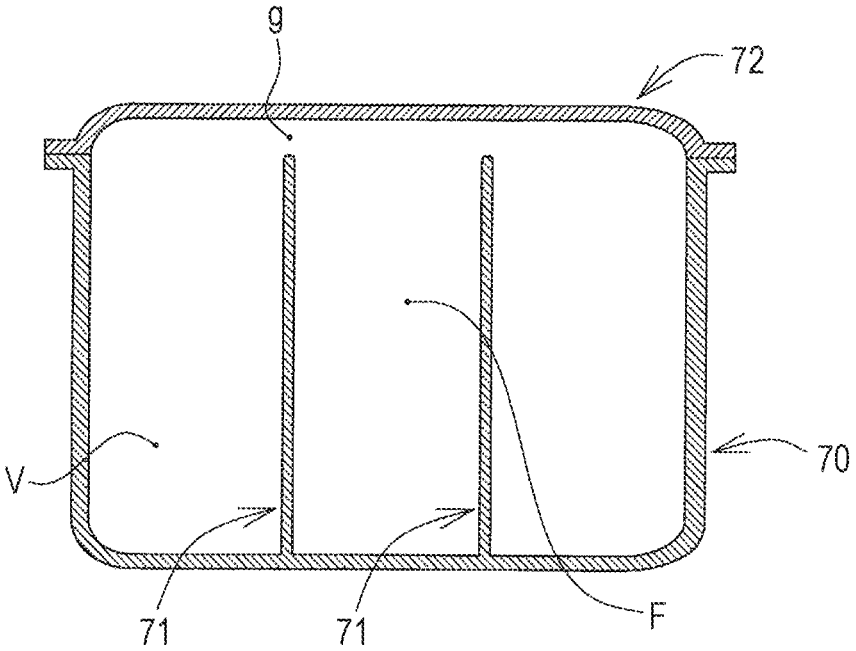
FIG. 9 is a sectional view of a structure of the rectification structural body of the reference example.

Moreover, a rectification structural body 7 illustrated as a reference example in FIG. 9 may be configured as the rectification structure provided with the rectifier configured to deflect the air flow in the chamber 13. In the rectification structural body 7, rectification ribs 71 integrally molded with a first case 70 are provided at the first case 70. Tip ends of the rectification ribs 71 and a second case 72 are apart from each other with a predetermined distance. FIG. 9 illustrates a section at a spot corresponding to FIG. 4. However, it has been found that even when the rectification structural body 7 has such a structure, air flow disturbance is caused, the output of the airflow sensor is destabilized, and the sensing performance is degraded.

Figure 7:
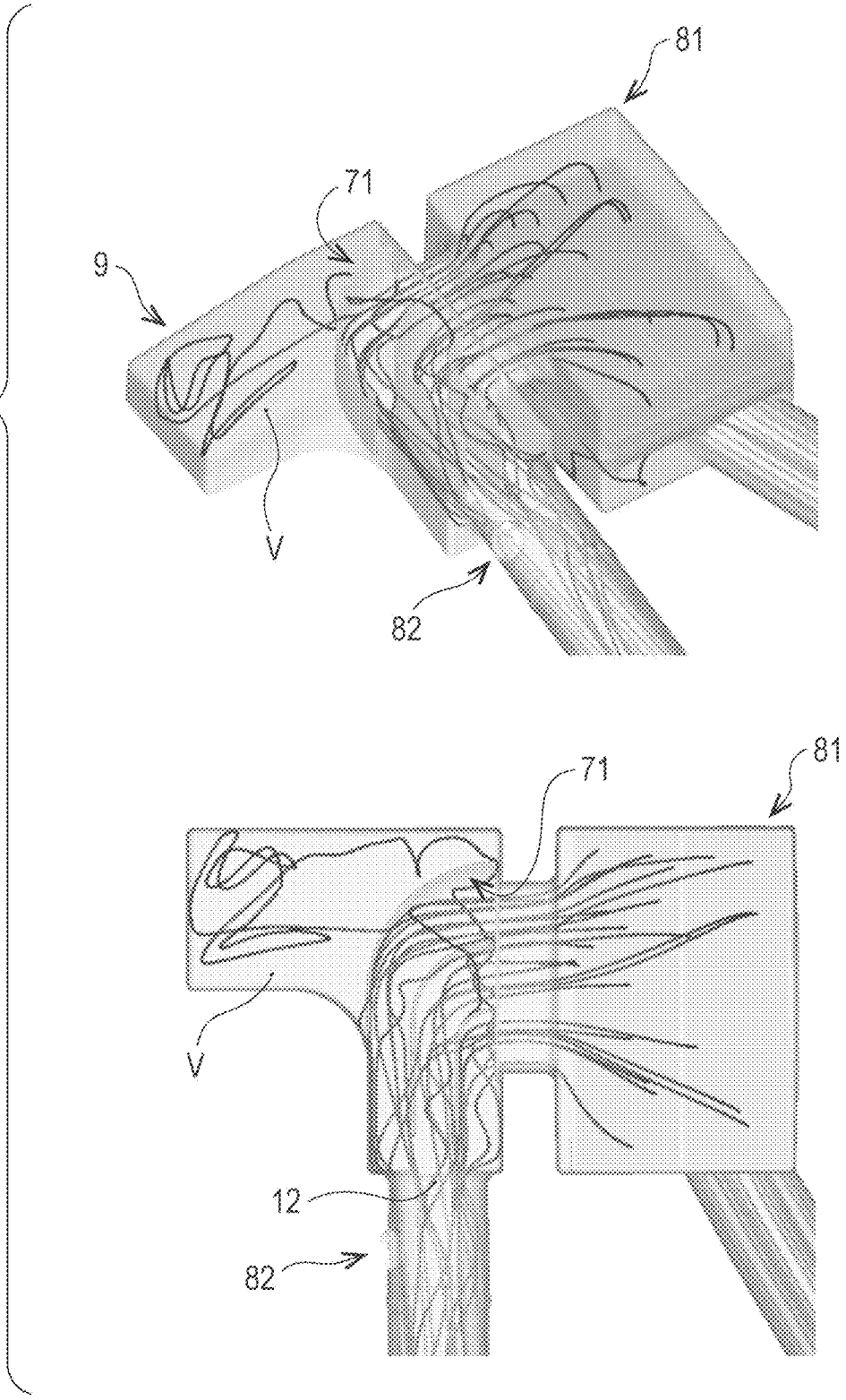
FIG. 7 is a perspective view and a plan view of an air flow simulation result in a rectification structural body of a reference example.

The air flow from the air cleaner to the airflow sensor in the rectification structural body in a case where the rectification structural body 7 of the reference example with the structure illustrated in FIG. 9 is incorporated between the air cleaner 81 and the airflow sensor 82 has been analyzed by numerical fluid simulation. FIG. 7 illustrates a flow line of an obtained analysis result. Note that as in the rectification structural body 1 of the first embodiment, a rib corresponding to a third rib is provided, and simulation of the air flow is performed.

According to FIG. 7, in the rectification structural body 7 of the reference example, part of air which is supposed to flow along a flow path F provided inside the rectification structural body passes through a clearance between a tip end portion of the rectification rib 71 and the second case 72, and flows into a space V separated from the flow path F by the rectification rib 71. Further, air having flowed into the space V returns again to the side of a flow path F1 through the clearance between the tip end portion of the rib 71 and the second case 72.

Such an air flow is a complicated air flow, and therefore, an eddy and the like are easily caused. Moreover, the flow of air having flowed out of an outlet port 12 of the rectification structural body 7 is also less stabilized. For this reason, the stability of the output of the airflow sensor 82 tends to be low.

On the other hand, in the rectification structural body 1 of the above-described embodiment, the end portion 21*a* of the first rib is apart from the second case 3, but the second rib 32 is provided substantially parallel to the first rib 21 to overlap with the first rib 21 with the predetermined spacing W. Thus, as viewed from the side of the flow path F1, the clearance g between the end portion 21*a* of the first rib and the second case 3 is closed by the second rib 32. Further, communication between the space V on the side opposite to the flow path and the flow path F1 is also communication through a bent communication path (a labyrinth-shaped communication path) by way of the inter-rib space where the first rib 21 and the second rib 32 overlap with each other.

This restrains air flowing in the flow path F1 from flowing into the space V on the side opposite to the flow paths through the clearance g between the end portion 21*a* of the first rib and the second case 3. Thus, the flow of air flowing in the flow path F1 is substantially separated from the space V on the side opposite to the flow path, and such air smoothly flows along the first rib 21 and the second rib 32.

Figure 6:
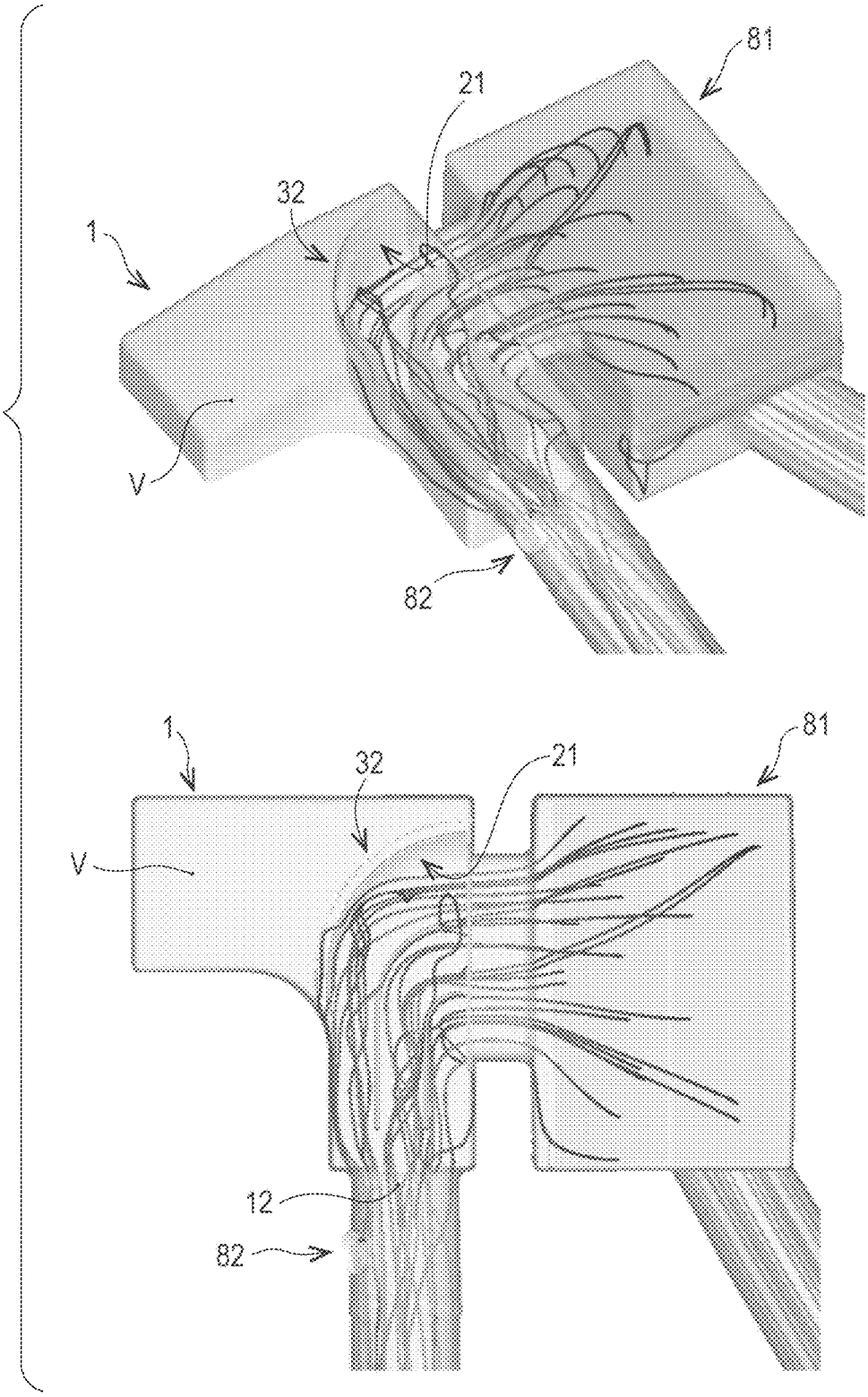
FIG. 6 is a perspective view and a plan view of an air flow simulation result in the rectification structural body of the first embodiment.

The air flow from the air cleaner to the airflow sensor in the rectification structural body 1 in a case where the rectification structural body 1 of the first embodiment is incorporated between the air cleaner 81 and the airflow sensor 82 has been analyzed by numerical fluid simulation. FIG. 6 illustrates a flow line of an obtained analysis result. Simulation conditions are similar to those of the reference example illustrated in FIG. 7, except for the presence or absence of the second rib 32. The length of the clearance g between the end portion 21*a* of the first rib 21 and the second case 3 is 8 mm. The distance W between the first rib 21 and the second rib 32 is 8 mm. The overlapping length L between the first rib 21 and the second rib 32 is 20 mm.

According to the analysis result of the rectification structural body 1 of the first embodiment of FIG. 6, no air flowing in the flow paths F1, F2 substantially flows into the space V separated from the flow path F1 by the first rib 21 and the second rib 32. Thus, it has been found that disturbance in the flow of air flowing in the flow paths F1, F2 is reduced and the air flow is promptly stabilized in the duct toward the airflow sensor 82.

In consideration of reduction in the air flow into the space V by the second rib 32, the overlapping length L between the first rib 21 and the second rib 32 is preferably longer than the length of the clearance g between the end portion 21*a* of the first rib 21 and the second case 3 and the distance W between the first rib 21 and the second rib 32. The overlapping length L is more preferably L≥2*g and/or L≥2*W.

As described above, according to the rectification structural body 1 of the above-described first embodiment, generation of air flow disturbance in the rectification structural body can be reduced. Thus, the output of the airflow sensor is stabilized, and the sensing performance is enhanced.

Although not essential, the third rib 23 having the substantially arc-shaped portion substantially parallel to the first rib 21 may be, as in the rectification structural body 1 of the above-described first embodiment, provided at the first case 2 to protrude to the inside of the flow path F. Further, the end portion 23*a* of the third rib 23 may be apart from the second case 3. With this configuration, the inside of the flow path F can be more effectively rectified by the third rib 23. As a result, the output of the airflow sensor is more stabilized, and the sensing performance is enhanced. As in the analysis example of FIG. 6, two third ribs 23 may be provided.

Moreover, in the case of providing the third rib as in the present embodiment, another rib may be further provided in the clearance g' between the third rib 23 and the second case 3 as in the second rib 32 provided in the clearance g between the first rib 21 and the second case 3. The other rib may be provided to protrude from the second case 3. With this configuration, less air flows back and forth between the flow path F1 and the flow path F2 divided by the third rib 23. Thus, more effective rectification can be implemented. Moreover, the output of the airflow sensor is more stabilized, and the sensing performance is enhanced.

Although not essential, the length of the clearance g between the end portion 21*a* of the first rib 21 and the second case 3 is preferably 2 mm to 20 mm, and the spacing W between the first rib 21 and the second rib 32 is preferably 2 mm to 20 mm. With this configuration, the output of the airflow sensor is particularly stabilized, and the sensing performance is enhanced. When the length of the clearance g and the spacing W increase, more air easily flows into the space V on the side opposite to the flow path. Thus, the length of the clearance g and the spacing W are preferably equal to or less than 20 mm. Moreover, when the length of the clearance g and the spacing W decrease, influence of a dimension error and dimension variation upon integration of the first case 2 and the second case 3 on the length of the clearance g and the spacing W is easily shown with a great probability. As a result, variation in performance of the rectification structural body 1 tends to be caused. For this reason, the length of the clearance g and the spacing W are preferably equal to or greater than 2 mm.

Moreover, although not essential, the Helmholtz resonator including the space V of the chamber 13 as the volume chamber separated from the flow path by the first rib 21 and the space between the second rib 32 and the first rib 21 as the communication pipe and having a resonant frequency of 100 Hz to 1500 Hz is preferably provided as in the rectification structural body 1 of the above-described first embodiment. With such a configuration, the rectification structural body 1 can stabilize the output of the airflow sensor and can enhance the sensing performance, and at the same time, can reduce intake noise by resonator resonant action.

Note that in the case of providing the resonator at the rectification structural body having the rectification rib in the typical technique, an opening of the communication pipe of the resonator is generally provided in the middle in a rectification rib flow direction. However, when the opening of the communication pipe is provided in the middle in the rectification rib flow direction, air flow disturbance resulting from the opening may be caused. For this reason, the output of the airflow sensor is easily destabilized, and the sensing performance is easily degraded.

In the rectification structural body as in the above-described first embodiment, the opening of a communication path of the Helmholtz resonator to an air flow path is continuously provided along the flow direction. Thus, air flow disturbance is less caused. Consequently, although the resonator is provided at the rectification structural body, the output of the airflow sensor can be stabilized, and the sensing performance can be enhanced.

The aspect of the present disclosure is not limited to that of the above-described embodiment, and various modifications can be made. Hereinafter, other embodiments of the present disclosure will be described. In description below, differences from the above-described embodiment will be mainly described, and detailed description of similar contents will be omitted. Moreover, these embodiments can be implemented with some of these embodiments being combined together or being replaced.

Figure 5A:
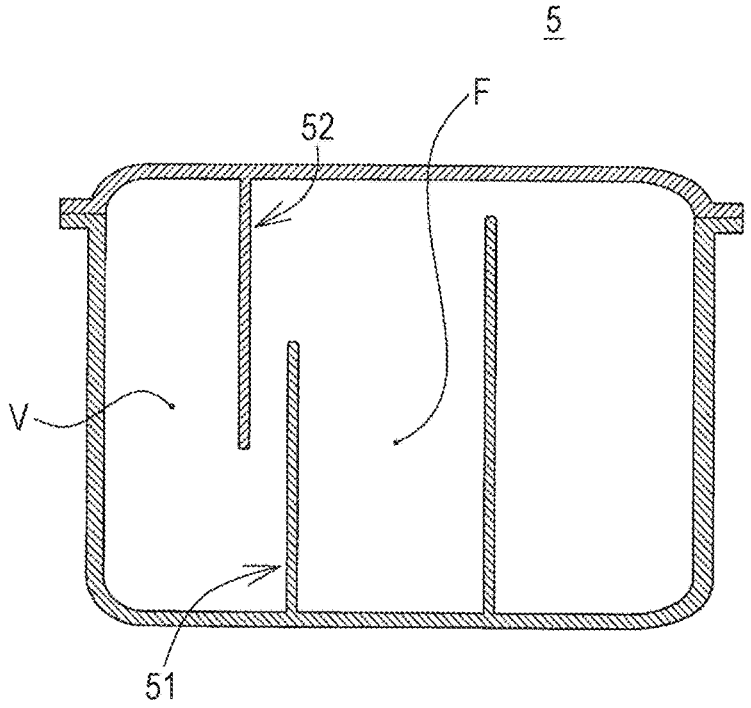
FIGS. 5A and 5B are sectional views of structures of rectification structural bodies of other embodiments.
Figure 5B:
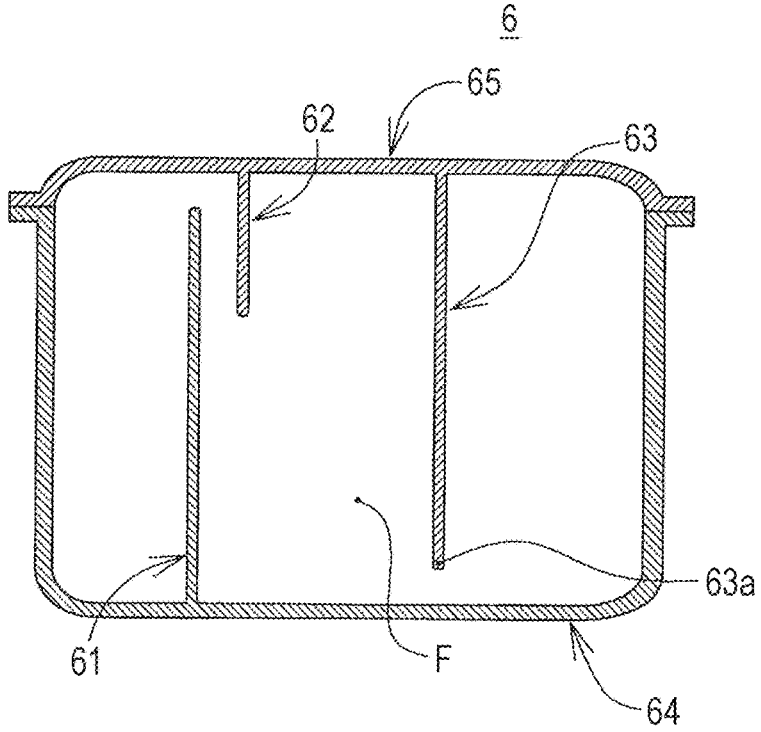

FIGS. 5A and 5B illustrate rectification structural bodies of other embodiments. The rectification structural bodies of the other embodiments illustrated in FIGS. 5A and 5B are different from the rectification structural body 1 of the first embodiment in a structure of a rib provided at the rectification structural body, and on the other points, are similar to the rectification structural body 1 of the first embodiment. FIGS. 5A and 5B illustrate an X-X section corresponding to FIG. 4 of the first embodiment.

FIG. 5A illustrates a rectification structural body 5 of a second embodiment. In the rectification structural body 5, a second rib 52 is provided substantially parallel to a first rib 51 to overlap with the first rib 51 with a predetermined spacing. Such a point is similar to that of the rectification structural body 1 of the first embodiment. On the other hand, in the rectification structural body 1, the separation distance (the length of the clearance g) between the end portion 21*a* of the first rib and the second case 3 is relatively short, and the overlapping portion between the first rib 21 and the second rib 32 is arranged at a position close to the second case 3. On the other hand, in the rectification structural body 5 of the second embodiment illustrated in FIG. 5A, the overlapping portion between the first rib 51 and the second rib is apart from a second case 3, and is arranged at a position close to the center (the center in an upper-to-lower direction of FIG. 5A) of an internal space of a chamber 13.

Even with the rectification structural body 5 of the second embodiment, welding burrs and the like are less caused as in the rectification structural body 1 of the first embodiment. In addition, the first rib 51 and the second rib 52 can together restrain air from flowing into a space V on the side opposite to a flow path F. With this configuration, the rectification structural body 5 can stabilize the output of an airflow sensor, and can enhance sensing performance.

Note that although not essential, the length of the clearance g between the end portion 21*a* of the first rib 21 and the second case 3 is preferably equal to or less than 20 mm and more preferably equal to or less than 10 mm in the rectification structural body of the first embodiment. Through such a clearance g (a separated portion), air may flow into the space V from the flow paths F1, F2. However, when the length of the clearance g between the end portion 21*a* of the first rib 21 and the second case 3 is equal to or less than 20 mm and specifically equal to or less than 10 mm, air which is about to flow into the space V flows in a portion close to the second case. In the portion close to the second case, the air flow velocity is lower than that of a center portion of the chamber 13. Thus, the air flow into the space V is more effectively reduced. Consequently, the output of the airflow sensor can be stabilized, and the sensing performance can be enhanced.

FIG. 5B illustrates a rectification structural body 6 of a third embodiment. The rectification structural body 6 is similar to the rectification structural body 1 of the first embodiment in the form of a provided first rib 61. In the rectification structural body 6 of the third embodiment, a second rib 62 is provided on the same side as that of a flow path F with respect to the first rib 61. That is, as in the third embodiment, the first rib 61 and the second rib 62 may be provided concentrically such that the second rib 62 is on the inner side of a circle.

In such a rectification structural body 6, welding burrs and the like are less caused as in the rectification structural body 1 of the first embodiment. In addition, the first rib 61 and the second rib 62 can together restrain air from flowing into a space V on the side opposite side to flow path F. With this configuration, the output of an airflow sensor can be stabilized, and sensing performance can be enhanced. Similarly, two second ribs may be provided in parallel, and an end portion of the first rib may be sandwiched between two second ribs. Even with this configuration, the output of the airflow sensor can be stabilized, and the sensing performance can be enhanced.

Moreover, in the rectification structural body 6 of the third embodiment, a fourth rib 63 having an arc-shaped portion substantially parallel to the first rib 61 is, at a second case 65, provided to protrude toward a first case 64 in the flow path F. An end portion 63*a* of the fourth rib 63 is apart from the first case 64.

In the case of providing such a fourth rib 63, an air flow in the flow path F is more favorably rectified. With this configuration, the output of the airflow sensor can be stabilized, and the sensing performance can be enhanced.

Further, in the rectification structural body 6, the second rib 62 or the fourth rib 63 favorably reduces direct blowing of air to a clearance (a separated portion) between the first rib 61 and the second case 65, the air having flowed into a chamber 13 through an inlet port. With this configuration, the output of the airflow sensor can be particularly stabilized.

In description of the above-described embodiments, e.g., description of a specific attachment structure provided at the rectification structural body has been omitted. As necessary, the rectification structural body can include an attachment structure such as a stay or a grommet. Moreover, for, e.g., a connection structure between the rectification structural body and the air cleaner and a connection structure between the rectification structural body and the pipe body to which the airflow sensor is attached, detailed description has been omitted. As necessary, the rectification structural body can include, at these connection portions, a fixing structure such as a seal material or a fixing band.

Moreover, regarding the first rib, a sound-absorbing material made of a porous material may be arranged in the space V on the side opposite to the flow path F in the rectification structural body of the above-described embodiments.

Further, the first embodiment has described the example where the rectification structural body is provided separately from the air cleaner. On this point, the rectification structural body may be integrated with the air cleaner.

The rectification structural body of the present embodiments can be used for the intake system of the internal combustion engine. The rectification structural body of the present embodiments can rectify the air flow toward the airflow sensor, and therefore, has a great potential in industry.

Moreover, the rectification structural body according to the present embodiments may be the following first rectification structural body.

The first rectification structural body is a rectification structural body provided between an air cleaner and an airflow sensor in an intake system of an internal combustion engine. The rectification structural body includes an inlet port into which air from the air cleaner flows, an outlet port from which air flows out toward the airflow sensor, and a chamber provided between the inlet port and the outlet port. The inlet port and the outlet port are provided in such directions and at such positions that a flow is bent in the chamber. The chamber includes two cases of a first case and a second case, the chamber being divided into the two cases. A substantially arc-shaped first rib is provided to protrude from the first case. An end portion of the first rib is apart from the second case. A substantially arc-shaped second rib is provided to protrude from the second case. The second rib is provided substantially parallel to the first rib to overlap with the first rib with a predetermined spacing. The first rib and the second rib form, in the chamber, a flow path wall such that the flow of air flowing into the chamber from the inlet port curves and directs toward the outlet port.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A rectification structural body comprising:

an inlet port into which air from an air cleaner flows;

an outlet port from which air flows out toward an airflow sensor; and a chamber provided between the inlet port and the outlet port, wherein the inlet port and the outlet port are provided in such directions and at such positions that an air flow is bent in the chamber, the chamber includes two cases of a first case and a second case, the chamber being divided into the two cases, a substantially arc-shaped first rib is provided to protrude from the first case, an end portion of the first rib is apart from the second case, a substantially arc-shaped second rib is provided to protrude from the second case, the second rib is provided substantially parallel to the first rib to overlap with the first rib with a predetermined spacing, and the first rib and the second rib form, in the chamber, a flow path wall such that a flow of air flowing into the chamber through the inlet port curves and directs toward the outlet port.

2. The rectification structural body according to claim 1, further comprising a Helmholtz resonator including a space of the chamber as a volume chamber separated from a flow path by the first rib and a space between the second rib and the first rib as a communication pipe, and having a resonant frequency of 100 Hz to 1500 Hz.

3. The rectification structural body according to claim 1, wherein a third rib having a substantially arc-shaped portion substantially parallel to the first rib is provided to protrude from the first case in a flow path, and an end portion of the third rib is apart from the second case.

4. The rectification structural body according to claim 2, wherein a third rib having a substantially arc-shaped portion substantially parallel to the first rib is provided to protrude from the first case in a flow path, and an end portion of the third rib is apart from the second case.

5. The rectification structural body according to claim 1, wherein a fourth rib having an arc-shaped portion substantially parallel to the first rib is provided to protrude from the second case in a flow path, and an end portion of the fourth rib is apart from the first case.

6. The rectification structural body according to claim 2, wherein a fourth rib having an arc-shaped portion substantially parallel to the first rib is provided to protrude from the second case in a flow path, and an end portion of the fourth rib is apart from the first case.

7. The rectification structural body according to claim 2, wherein a spacing between the end portion of the first rib and the second case is 2 mm to 20 mm, and a spacing between the first rib and the second rib is 2 mm to 20 mm.

* * * * *